US005202582A

United States Patent [19]

Szynal et al.

[11] Patent Number: 5,202,582

[45] Date of Patent: Apr. 13, 1993

[54] ELECTRONIC CONTROL FOR A DISHWASHER

[75] Inventors: Joseph M. Szynal, Center Township, Laporte County, Ind.; Kevin K. Borgerding, Benton Township, Berrien County, Mich.

[73] Assignee: Whirlpool Corporation, Benton Harbor, Mich.

[21] Appl. No.: 735,786

[22] Filed: Jul. 25, 1991

[51] Int. Cl.[5] ..... H02J 3/00

[52] U.S. Cl. ..... 307/39; 68/12.26; 134/58 DL; 307/18; 307/125; 307/141.1

[58] Field of Search ..... 307/112, 116, 125, 139, 307/141, 141.4, 11, 18, 31, 38, 39, 41; 134/57 D, 57 DL, 58 D, 58 DL; 68/12.23, 12.26

[56] References Cited

U.S. PATENT DOCUMENTS 3,850,185 11/1974 Guth ..... 134/58 DL
3,862,439 1/1975 Coccio ..... 307/647
4,213,313 7/1980 Kiefer et al. ..... 307/141.4
4,241,400 12/1980 Kiefer ..... 364/400
4,245,309 1/1981 Kiefer ..... 364/400
4,245,310 1/1981 Kiefer ..... 364/400
4,305,122 12/1981 Smith et al. ..... 364/144
4,467,423 8/1984 Smith et al. ..... 364/144 X
4,866,955 9/1989 Blair et al. ..... 68/12.23
5,006,767 4/1991 Maruyama et al. ..... 134/58 D

*Primary Examiner*—Jeffrey A. Gaffin
*Attorney, Agent, or Firm*—Baker & Daniels

[57] ABSTRACT

An appliance control circuit used in a dishwasher which includes only a single door switch which is used both for disabling/enabling the AC voltage components of the dishwasher and which also provides an input to the microprocessor of the control circuit. A zero crossing conditioning circuit is also included to condition the door switch signal and to provide it to the microprocessor. The microprocessor control is electrically isolated from the grounded side of the line voltage.

7 Claims, 2 Drawing Sheets

ELECTRONIC CONTROL FOR A DISHWASHER

BACKGROUND OF THE INVENTION

This invention relates to dishwasher controls and in particular to a dishwasher control for detecting the opening of the dishwasher door and thereupon disabling operation of the dishwasher. In particular this application relates to a very simple microprocessor based dishwasher control which has a single pole, single contact door switch and which eliminates the need for optical couplers, operational amplifiers and the like in connection with providing an input to the microprocessor of of the condition of the appliance door.

With the ready availability of microprocessors, appliance controls such as controls for dishwashers have widely incorporated microprocessors. When incorporated in such controls, the microprocessor receives inputs from various sensors and provides outputs to control the various operational elements of the dishwasher such as the pump, a water valve, detergent and wetting agent dispensers, heaters and the like. In order to provide an indication to the microprocessor that the dishwasher door is open while at the same time disabling the various operational elements, many prior art dishwashers have included two door switches, one of which directly disables the operational elements and the other of which is used to provide an indication input to the microprocessor that the door is open.

One problem with the use of two switches has been that, as more switch contacts are used and complexity increases, the likelihood of failure increases likewise.

Furthermore, since the microprocessor operates at low voltage and since the door switches are subject to line voltage, conventionally the input from the door switch to the microprocessor has been isolated electrically from the microprocessor by the use of optical couplers, operational amplifiers and the like. In order to accomplish input to the microprocessor with such circuitry various other electric components have also been utilized to achieve the desired isolation of the microprocessor from line voltage. Such components add undesired expense and complexity to dishwasher controls. Further, the microprocessor control has conventionally been grounded to the neutral side of the power source. This arrangement has required additional circuit components.

Accordingly, it is desired to provide a very simple dishwasher control wherein only a single door switch is used which provides both the function of disabling the dishwasher pump and the function of indicating to the microprocessor that the door is open. Furthermore, it is desired to provide such a dishwasher control which does not utilize isolation devices such as optical couplers, operational amplifiers and the like. Lastly, it is desired to provide such a control which is very simple and inexpensive.

SUMMARY OF THE INVENTION

The present invention overcomes the disadvantages of the above described prior art dishwasher control circuits by providing an improved control circuit therefor.

The control circuit according to the present invention, in one form thereof, includes only a single switch which serves both to disable the line voltage operated electrical elements of the dishwasher and further serves as an input to the microprocessor. The control circuit includes a conditioning circuit which shapes and conditions the voltage signal indicative of the door position and which provides the conditioned signal directly to the microprocessor without the use of isolating optoelectric couplers, operational amplifiers and the like.

The control circuit according to the present invention, in one form thereof, includes a power supply adapted to be connected to a source of electric power and includes means for electrically isolating the output side of the power supply from the source of electric power. A microprocessor is connected to the output side of the power supply and the microprocessor is adapted to control the appliance during a cycle of operations. A door switch is mounted on the appliance and is connected to the electrical components for disabling operation of the appliance line operated components when the door is in the open position and for enabling operation of the components when the door is in the closed position. The switch includes only two contacts and a means for bridging the contacts. One of the contacts is connected to the grounded side of the source of electric power. The control circuit also includes a conditioning circuit means for conditioning an electric signal. The conditioning circuit is electrically connected to the ungrounded side of the source of electric power, to the other of the switch contacts, and to the microprocessor for providing an input to the microprocessor regarding the position of the dishwasher door.

An advantage of the control circuit according to the present invention is that it is significantly simplified as compared to prior art appliance control circuits. Thus the control circuit includes few components, is lower in cost and is less subject to failure than prior art appliance controls.

A further advantage of the control circuit according to the present invention is that the single switch of the circuit both shuts down the electric, line voltage operated, components of the dishwasher and furthermore provides an input to the microprocessor. Since the circuit is so configured that the microprocessor is not referenced to the grounded side of the source of electric power and thus is in a floating electric condition and since the control circuit is referenced to the ungrounded side of the source of electric power, the microprocessor control circuit floats up and down with the ungrounded side of the line. By means of this arrangement the circuit includes fewer components with the attendant advantages described above.

A further advantage of the invention is that, the circuit also may be used to provide an input for performing triac phase control.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawing, wherein.

The exemplification set out herein illustrates a preferred embodiment of the invention, in one form thereof, and such exemplification is not to be construed as limiting the scope of the disclosure or the scope of the invention in any manner.

DESCRIPTION OF THE PREFERRED EMBODIMENT

Figure 1:
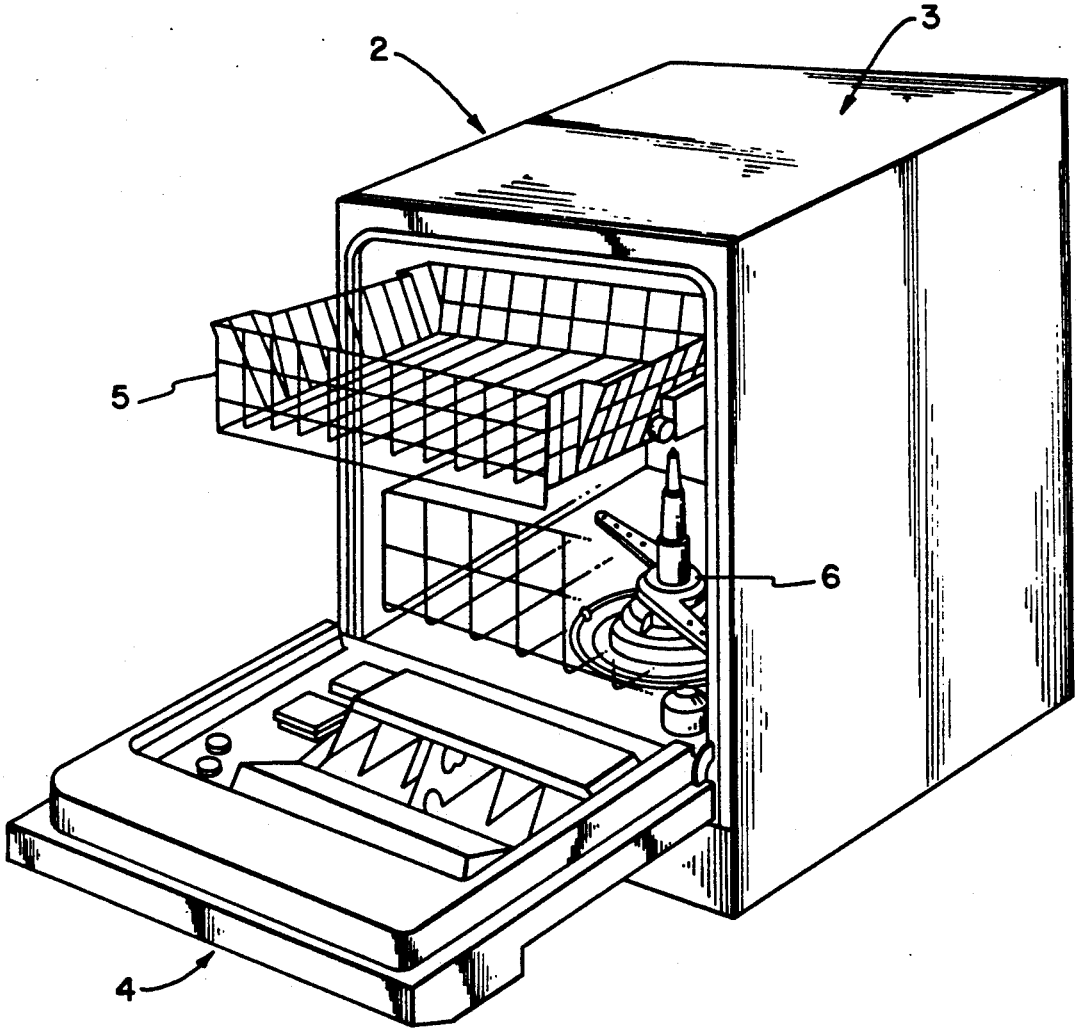
FIG. 1 is a perspective representation of a dishwasher.

FIG. 1 discloses a dishwasher including a cabinet 2 having a top 3 and a door 4. The dishwasher cavity contains extendable baskets for receiving dishes to be washed. Furthermore, a spray arm arrangement 6 is located in the cavity for spraying water on the dishes to clean the same.

Figure 2:
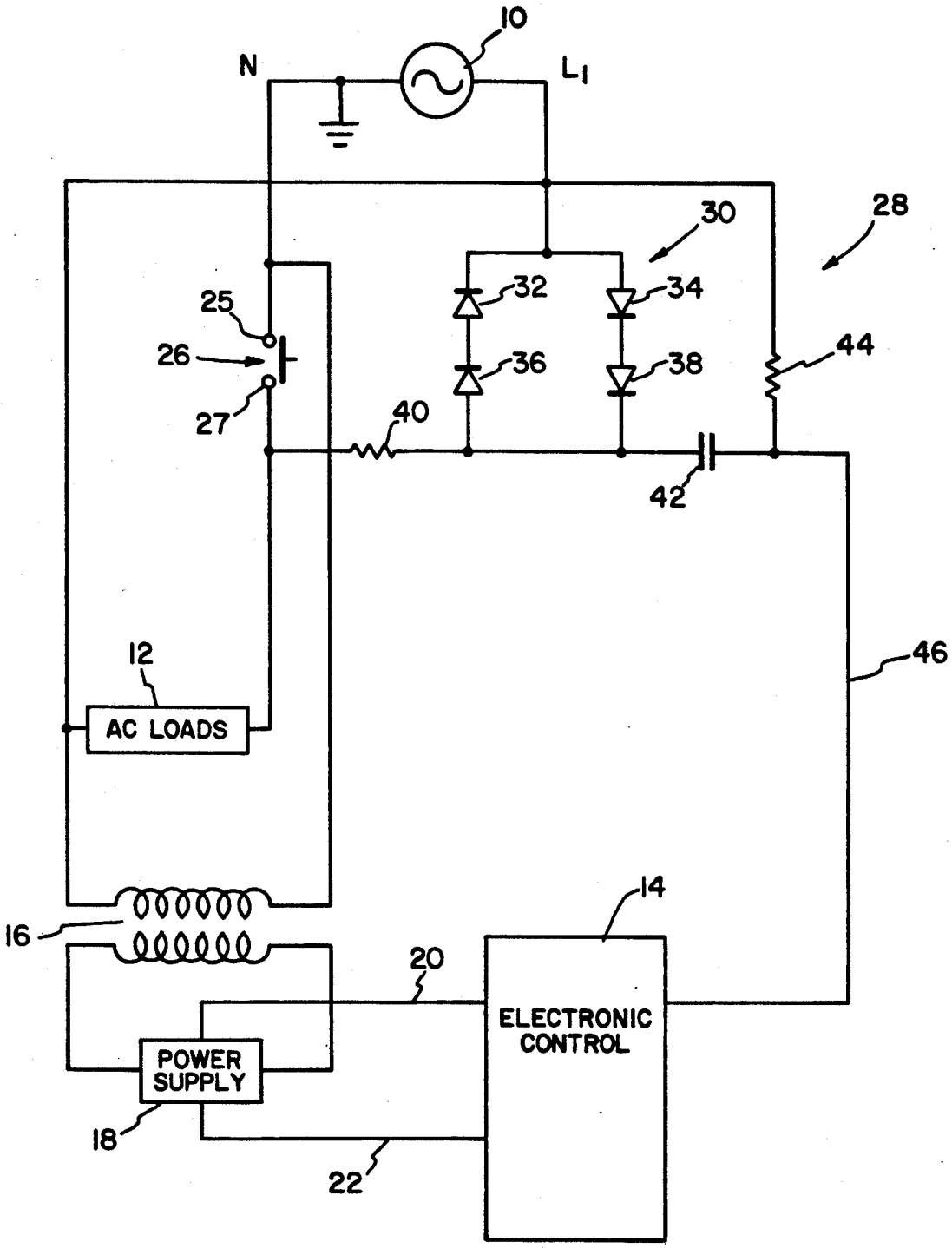
FIG. 2 is a schematic drawing of the control circuit of the present invention.

FIG. 2 discloses a schematic circuit drawing including a line source 10 of AC power. One side of the power source is grounded and is commonly referred to as neutral (N). The ungrounded side of the power source is labeled L1. The appliance includes a number of AC loads 12. For a typical dishwasher appliance the loads will include a reversible pump, air and water heaters, a water valve, a detergent dispenser and a wetting agent dispenser. These AC loads 12 are connected directly across power source 10. An electronic control including a microprocessor is indicated at 14. The electronic control is powered by means of a power supply 18 including a transformer 16 which isolates the output side of power supply 18 electrically from power source 10. Power supply 18 receives as input the output of the secondary of transformer 16. The output from the power supply is connected to the electronic control by means of leads 20 and 22. Thus it can be seen that the electronic control is isolated from the AC power source and is not connected to a common ground therewith. Accordingly, the electronic control will be in a floating condition.

A door switch 26 is mounted on the appliance cabinet (not shown) in such a way that the door switch will open when the appliance door is opened and will close when the appliance door is closed. Such door switch arrangements are conventional and are utilized so that, when the user opens the door of the appliance the operation of the AC loads 12 of the appliance will cease. When the appliance is again closed, the appliance can resume operation. Accordingly, the electronic control also has to be notified of the opening of the door so that it can interrupt the appliance operating cycle. However, electrical power must continue to be supplied to the electronic control so that the appliance cycle is merely interrupted and need not be restarted upon the opening and closing of the door. Accordingly, it can be seen that transformer 16 is connected in such a way that the primary thereof bypasses door switch 26.

A conditioning circuit 28 is shown which includes a diode clamp 30 comprised of rectifiers 32, 34, 36, and 38. Contact 25 of switch 26 is connected to neutral. The other contact 27 of switch 26 is connected by means of a resistor 40 to diode clamp 30. A capacitor 42 is connected between diode clamp 30 and connector lead 46 which in turn is connected to the electronic control and provides an input thereto. Finally, a resistor 44 is connected from connecting lead 46 to the ungrounded side L1 of power supply 10. Diode clamp 30 is directly connected to the ungrounded side L1 of power source 10. Together, diode clamp 30 and resistors 40 and 44 define a zero crossing circuit.

When door switch 26 is open, no potential exists across resistor 40 or full diode clamp 30. Accordingly, the input to electronic control 14 on 46 will be pulled high by resistor 44.

On the other hand, when door switch 26 is closed, line potential appears across the combination of resistor 40 and the diode clamp 30. A saw tooth waveform is generated on line 46, which saw tooth wave is detected by the electronic control to determine that the door switch is closed.

Thus, by virtue of not referencing the control circuit to a common ground with the power source, the low voltage electronic control will ride on the voltage present on line L1. This enables substantial simplification of the circuit as compared to prior art circuits.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A control circuit for an appliance, said appliance including a cabinet having an access opening therein for providing access to the interior of said cabinet, an access door movable between open and closed positions for selectively opening and closing said access opening, and electrical components for performing a plurality of operations, said appliance adapted to be connected to a source of electric power, said source of power having a grounded side and an ungrounded side, said circuit comprising:

a power supply including means for connection to the source of electric power, and including means for electrically isolating an output side of said power supply from the source of electric power;

a microprocessor connected to said power supply, said microprocessor including means for controlling said appliance during a cycle of operations;

a door switch including means for mounting said switch on said appliance, said switch connected to said electrical components for disabling operation of said components when said door is in the open position and for enabling operation of said components when said door is in the closed position, said switch including only two contacts and means for bridging said contacts, one of said contacts being connected to the grounded side of the source of electric power;

conditioning circuit means for conditioning a voltage signal and including means for connection to the ungrounded side of the source of electric power and connected to the other of said switch contacts and to said microprocessor for providing an indication input to said microprocessor regarding the condition of said door switch.

2. The circuit according to claim 1 wherein said conditioning means is a zero crossing circuit.

3. The circuit according to claim 1 wherein said conditioning circuit includes a diode clamp circuit, a first resistor directly connected to said other contact, and a second resistor connected to said source of electric power and connected to said microcomputer.

4. The circuit according to claim 3 including a capacitor connected between said first and second resistors.

5. A control circuit for an appliance, said appliance including a cabinet having an access opening therein for providing access to the interior of said cabinet, an access door movable between open and closed positions for selectively opening and closing said access opening, and electrical components for performing a plurality of operations, said appliance adapted to be connected to a source of electric power, said source of power having a grounded side and an ungrounded side, said circuit comprising:

a power supply including means for connection to the source of electric power, and including means for electrically isolating an output side of said power supply from the source of electric power;

a microprocessor connected to said power supply, said microprocessor adapted for controlling said appliance during a cycle of operations;

a door switch including means for mounting said switch on said appliance, said switch connected to said electrical components for disabling operation of said components when said door is in the open position and for enabling operation of said components when said door is in the closed position, said switch including only two contacts and means for bridging said contacts, one of said contacts being connected to the grounded side of the source of electric power;

a zero crossing circuit electrically including means for connecting to the ungrounded side of the source of electric power, said zero crossing circuit connected to the other of said switch contacts and to said microprocessor for providing an indication input to said microprocessor regarding the position of said door.

6. The circuit according to claim 5 wherein said zero crossing circuit includes a diode clamp circuit, a first resistor directly connected to said other contact, and a second resistor adapted to be connected to said source of electric power and connected to said microprocessor.

7. The circuit according to claim 6 including an capacitor connected between said first and second resistors.

* * * * *